US005256115A

United States Patent [19]

Scholder et al.

[11] Patent Number: 5,256,115

[45] Date of Patent: Oct. 26, 1993

[54] ELECTRONIC FLYWHEEL AND CLUTCH FOR EXERCISE APPARATUS

[75] Inventors: William G. Scholder, Rockaway, N.J.; Donald A. Gilbrech, Fayetteville, Ark.

[73] Assignee: William G. Scholder, Rockaway, N.J.

[21] Appl. No.: 675,082

[22] Filed: Mar. 25, 1991

[51] Int. Cl.[5] ..... A63B 21/005

[52] U.S. Cl. ..... 482/6; 482/4; 482/63; 482/901; 482/903; 128/25 R

[58] Field of Search ..... 482/1, 4, 5, 6, 7, 57, 482/63, 900, 901, 902, 903; 73/379; 128/25 R

[56] References Cited

U.S. PATENT DOCUMENTS 3,057,201 10/1962 Jaeger .
3,395,698 8/1968 Morehouse .
3,454,942 7/1969 Chamberlin, Jr. et al. .
3,505,992 4/1970 Jaeger .
3,744,480 7/1973 Gause et al. ..... 128/707
3,767,195 10/1973 Dimick ..... 482/5
3,848,467 11/1974 Flavell ..... 482/4
4,084,810 4/1978 Forsman ..... 482/5
4,141,248 2/1979 Bargenda ..... 73/379
4,323,237 4/1982 Jungerwirth ..... 482/5
4,358,105 11/1982 Sweeney, Jr. ..... 482/901 X
4,408,183 10/1983 Wills ..... 340/323 R
4,790,528 12/1988 Nakao et al. ..... 482/63 X
4,934,692 6/1990 Owens ..... 482/63
4,941,652 7/1990 Nagano et al. ..... 482/903 X
5,050,865 9/1991 Augspurger et al. ..... 482/901 X

*Primary Examiner*—Richard J. Apley
*Assistant Examiner*—Joe H. Cheng

[57] ABSTRACT

An exercise apparatus which provides a variable load torque that substantially equals and opposes any possible input torque. A set of pedals is used to provide an input torque which is transmitted to the load. A speed reference command generator compares the input torque to a load torque setting and generates an electronic speed reference command signal. This signal is communicated to a speed servo to force the input speed to equal the speed reference command signal.

18 Claims, 5 Drawing Sheets

ELECTRONIC FLYWHEEL AND CLUTCH FOR EXERCISE APPARATUS

BACKGROUND OF THE INVENTION

Field of the Invention

The present invention relates to an exercise apparatus; and more particularly, to a stationary exercise bicycle which electronically provides an adjustable load torque to control the intensity of an exercise session.

Description of Related Art

Exercise equipment has become very popular in recent years. Commonly used equipment, particularly stationary exercise bicycles, have a suitable means, such as pedals, for the operator to assert a force against the equipment. The operator of a stationary bicycle sits on an adjustable seat which is conveniently located to enable the operator to pedal, and to monitor and reach a control panel. Many types of exercise bicycles provide an electronically controlled load torque. The load torque represents the torque which opposes the pedals.

Electronically controlled, as well as manually controlled stationary bicycles typically use a large flywheel to smooth out the pedaling operation. This is required because during each pedal revolution, the applied torque to the pedal varies with foot position. At the bottom of the pedaling stroke it is very difficult to apply torque. Without a large flywheel, large speed variations and a jerky motion would occur. The flywheel represents a large inertia which is most effective at high speeds. The inertia is accelerated when the applied pedal torque exceeds the load torque and decelerates when it is less than the load torque. During the portion of the pedal cycle when the required pedal torque, to maintain the pedal speed cannot be applied, the flywheel releases stored energy to keep the speed at a near constant value. The speed of rotation of the pedals is based on the integral of (pedal torque minus load torque divided by the inertia). $S=\int(Tp-T1)/J$ where S=pedal speed; Tp=pedal torque; T1=load torque; and J=inertia of the flywheel. For a large flywheel, the speed variation during a single revolution is minimized and the ride is smooth.

A stationary exercise bicycle which can automatically control the load torque usually becomes very complicated. The interconnection of pedals, clutch, gearing, flywheel and an electromagnetic device to provide a load torque leads to a heavy, bulky and often unreliable design. Alignments, adjustments and repairs are not easily accomplished by the average consumer. As a result of the size and weight, shipping costs are high.'

SUMMARY OF THE INVENTION

The present invention relates to an apparatus, preferably a stationary exercise apparatus, and most preferably a stationary exercise bicycle. This invention provides a stationary bicycle with an electronic flywheel which performs as if a large conventional flywheel were part of the equipment.

The apparatus of the present invention comprises a torque means, preferably a motor, to create a load torque. There is a transmission means to connect an input torque means to the opposing load torque means. The transmission means is a means to transmit power from the input torque means to the load torque means. It is preferably an assembly of parts, including speed-changing gears and shafts.

In a specific and preferred embodiment of this invention, the input torque is provided by an input torque means, including pedals, handles, steps, and the like, with pedals most preferred. The load torque means to provide the load torque can include a DC motor, generator, alternator, hysteresis motor, eddy current devices, and the like, with a DC motor preferred. The input torque means is connected to the load torque means by a suitable transmission means such as a gear box, individual gears and shafts connected by chains or belts or the like, with a gear box most preferred.

A control means compares the input torque, provided at an input speed, to a load torque setting and generates an electronic speed reference command signal which is a function of their difference. There is a means to communicate this signal to control means which force the input speed to equal the speed reference command signal.

The preferred control means is a "speed servo" system. The term "speed servo" means a system that controls speed to agree with a speed reference command signal which can be preset or computed. This signal is generated by the "speed reference command generator". The "speed reference" signal is based on the equation $$S=\int(T_p-T_1)/J$$

where

S is the speed reference signal;

$T_p$ is an input torque signal;

$T_1$ is a preset load torque signal;

J is a selected value which corresponds to an inertia

Variations in the input torque causes S to gradually change. S typically has a maximum value of about 140 revolutions per minute (RPM). The value for J is experimentally determined. The larger the value of J, the slower the value S changes.

The "speed servo" compares S to the input speed and adjusts the motor load torque to force the pedal speed to equal S. The input speed can be determined by suitable means such as being related to the back EMF of a DC motor. Alternatively, the means to measure the input speed can be a tachometer generator, a digital tachometer, or the like. Since S is nearly constant (during a single revolution of the pedals), the pedal speed is also nearly constant. A constant speed implies a net torque ($T_{pedal}-T_{motor}$) of zero; thus, the speed servo will create an opposing motor torque which follows any input torque at the pedals.

When the "speed reference" is gradually increasing, the input (pedal) torque is slightly greater than the motor supplied load torque. This is true because part of the input torque is required for acceleration (a velocity increase); but, because the system inertia and acceleration are so small (no large flywheel), the acceleration torque ($T_a$) is negligible compared to the input torque ($(T_{pedal}-T_{motor})=T_a=J_{system}\times$acceleration); therefore, even during acceleration (when S increases), the measured motor torque can be considered to be equal to the pedal input torque.

This apparatus provides an electronic flywheel which performs as if a large conventional flywheel were present. As the pedal torque increases, the speed reference and pedal speed both gradually increase. Their values are governed by the same equation that determines the speed for a conventional flywheel. The average load torque produced equals a preset load torque value which is automatically or manually selected. To maintain a given input speed, the input torque equals the load torque setting.

A preferred apparatus comprises a motor, a flexible coupling, a gear box, pedals and control electronics. The gear box has a pedal shaft which rotates in response to rotation of the pedals, and a high speed gear box output shaft. The pedal shaft torque is transferred through gears in the gear box to the high speed gear box output shaft. The motor shaft is connected to the gear box output shaft. The connection is preferably through the flexible coupling.

In a preferred embodiment, there can be a "small flywheel" connected to the high speed gear box output shaft. The purpose of this flywheel is to smooth out any roughness in the gear box and to provide some minimal inertia required to coast through the frictional torque in the gear box whenever the motor load torque falls to zero. By "small flywheel" it is meant a flywheel with an inertia value preferably less 10, more preferably less than 1 and most preferably from 0.2 to 0.6 with a useful value of 0.5 lb-in-sec$^2$. For a conventional flywheel, the inertia value is typically between 50.0 and 100.0 lb-in-sec$^2$ (or between 100 to 200 times as large). The present invention can be used to eliminate or reduce the size of conventional flywheels.

Where the apparatus of the present invention is a stationary bicycle, it can further comprise an adjustable seat located to enable an operator to sit on the seat and operate the pedals. There is preferably a control panel having a means to display the torque load setting (or related variable) and the pedaling velocity. The pedaling velocity can be calibrated to read in revolutions per minute (RPM). The panel is located to enable the operator to reach it while sitting on the seat. Preferably the panel is connected to a stationary bicycle frame.

The apparatus of the present invention enables exercise equipment, particularly stationary bicycles to be smaller, lighter, quieter and more attractive in appearance. The design reduces costs and provides a simpler machine to assemble and repair. Because there is no need for a large conventional flywheel, the clutch commonly associated with stationary bicycles can also be eliminated.

DESCRIPTION OF THE PREFERRED EMBODIMENTS

The present invention will be understood by those skilled in the art by reference to FIGS. 1 to 5 taken with the following description of the preferred embodiments.

Figure 3:
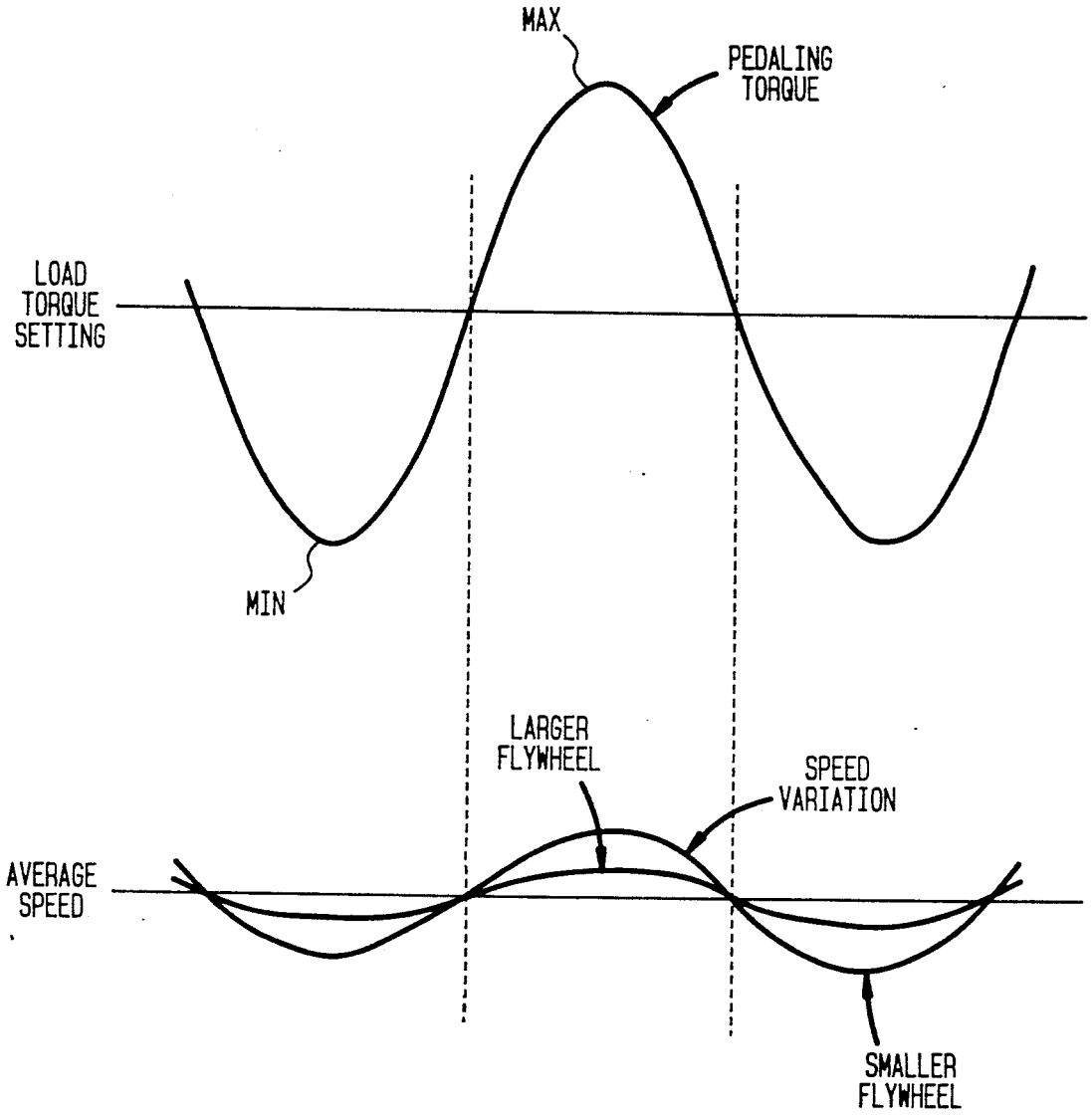
FIG. 3 is a graph of pedal torque and speed versus time. For a specific pedaling torque profile, speed variations for different size flywheels are shown. The pedal torque profile varies sinusoidally for a single revolution of pedaling. This variation causes a similar speed variation which is reduced by a large flywheel as opposed to a small flywheel.

The functional goal of the present invention can be appreciated by reference to FIG. 3. FIG. 3 is directed to the operation of an exercise machine with a sinusoidal input torque by the operator such as is present during the pedaling of a stationary bicycle. In the preferred embodiment of a stationary bicycle, the operator presses down on the pedal. When the pedal is a short distance beyond the highest position, the pedaling torque generated is at a maximum and when the pedal is at the lowest position the pedaling torque generated is at a minimum. Equipment presently in use apply a constant load torque against the input torque and rely on a large flywheel to maintain a near constant speed during a pedal revolution. The flywheel provides inertia to even out the torque to the pedal shaft during the variations of input pedal torque. Typically, a large flywheel provides for minimal speed variation at the pedal and a smoother ride. For the purposes of this explanation, the desired load torque setting is illustrated as a constant value but the actual load torque setting can slowly vary with time such as when simulating riding a bicycle up and down hills.

The present invention is a new type of stationary bicycle which electronically simulates the inertia formally provided by a large flywheel. There is no need for a large flywheel to compensate for pedaling torque input variation. Instead, the motor load torque is adjusted by a speed servo 61 to compensate for pedaling input torque variations. The elimination of a flywheel enables the system to be quieter, more compact, lighter, easier to assemble and to repair.

The apparatus of the present invention is useful as an exercising apparatus, preferably stationary exercise apparatus, and most preferably a stationary exercise bicycle. The present invention can be used in association with other exercising equipment requiring inertia loads.

Figure 1:
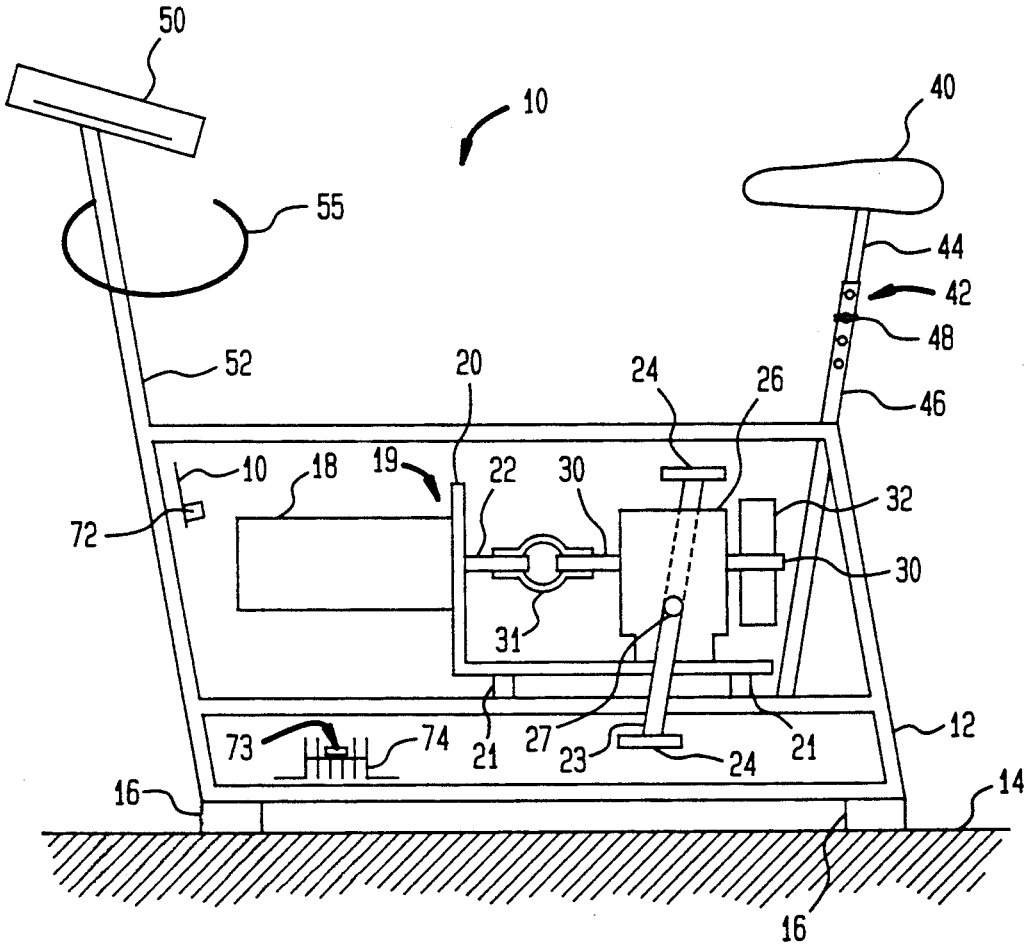
FIG. 1 is a drawing of a side view of a preferred embodiment of the apparatus of the present invention in the form of a stationary bicycle.

FIG. 1 illustrates the apparatus of the present invention as a stationary exercise bicycle 10. The bicycle preferably has a frame 12. The frame can be placed directly on the floor 14 or can have legs or feet 16.

There is a motor 18 which is mounted on the frame 12. Preferably, the motor is mounted on a subassembly 19 having a subassembly frame 20. Alternatively, the motor 18 can be mounted on the frame 12. Suitable motor mounts 21 are preferably made of a vibration absorbing material, such as plastic or hard rubber. The motor 18 comprises a motor shaft 22. The motor shaft 22 rotates about its axis in response to a current in the motor 18 and the applied pedaling torque.

For the purpose of the present invention, the most useful motors are direct current motors. Preferred motors include brush-type permanent magnet direct current motors. The motor rating is preferably between one sixth and one third horsepower. The back electromotive force (EMF) constant is preferably greater than 0.040 V (volts)/RPM (revolutions per minute). The internal resistance is preferably less than 3 ohms. The motor dimensions are not critical for operation. However, for packaging purposes it is preferred that the motor be less than 4 inches in diameter with a useful motor having a diameter from 3.5 to 4.0 inches. The motor is preferably less than 12 inches long and more preferably about 8 inches long.

There is a means to apply an input torque. The means to apply the input torque can be a set of pedals 24. The pedals 24 can be connected by suitable means to the motor shaft 22. There is preferably a gear box 26 connected to the pedals 24 through crank arm 23. The pedals 24 are connected to the low speed gear box input shaft 27 which is connected to gears within the gear box (not shown). High speed gear box shaft 30 is interconnected to gears within the gear box 26 and rotates about its axis in response to rotation of the pedals 24. The gear box 26 can be mounted on the subassembly frame 20 as part of the subassembly 19.

Gear boxes useful as gear box 26 are commercially available. Useful gear boxes include worm gears but other types of gears can be used. Conventional use of this type of gear box delivers torque out of the low speed shaft 27. For this application, the gear box is back driven by applying the pedal torque to the low speed shaft 27. The gear boxes when back driven typically have efficiencies of about 40%. The gear ratio preferably ranges from about 5 to 15, with a gear ratio of 10:1 most preferred. The gear box preferably is rated at from 0.5 to 2 horsepower, and most preferably about one horsepower. A useful gear box is preferably about 5 inches×5 inches×4 inches.

The high speed gear box shaft 30 is interconnected to the motor shaft 22 by suitable means. Preferably, the two shafts are axially connected by a coupling 31 which is preferably a flexible coupling. The flexible coupling is preferably from 1.5 to 2.5 inches long, and most preferably 2 inches long and should allow for lateral misalignments which are typically up to 0.06 inches and angular misalignments typically up to 2 degrees.

The apparatus of the present invention optionally and preferably further comprises a small flywheel 32 attached to the high speed shaft 30 to provide a smooth feel to the gear box. This flywheel is an auxiliary flywheel which smooths out roughness in the gear box and helps to overcome friction in the system. The size of the flywheel is not critical with a preferred diameter of from 3.5 to 4 inches with a most preferred flywheel having a diameter of about 3.9 inches. The axial length is not critical and can be up to 4 inches, preferably less than 3 inches long with a preferred flywheel being 2 inches in length and weighing up to about 8 pounds. For purposes of comparison, flywheels on conventional stationary bicycles typically weigh from 25 to 50 pounds and have a diameter of from 12 to 24 inches.

The exercise bicycle of the present invention has a seat 40 located to enable the operator's feet to comfortably reach pedals 24. Preferably, the seat 40 is connected to frame 12 by extension 42. The extension 42 preferably has a length adjust means to raise and lower the seat for different size operators. A preferred length adjust means is for seat 40 to be connected to rod 44 which telescopes into tube 46 connected to frame 12. The rod 44 and tube 46 can be keyed 48 to set the desired height of the seat 40.

Figure 4:
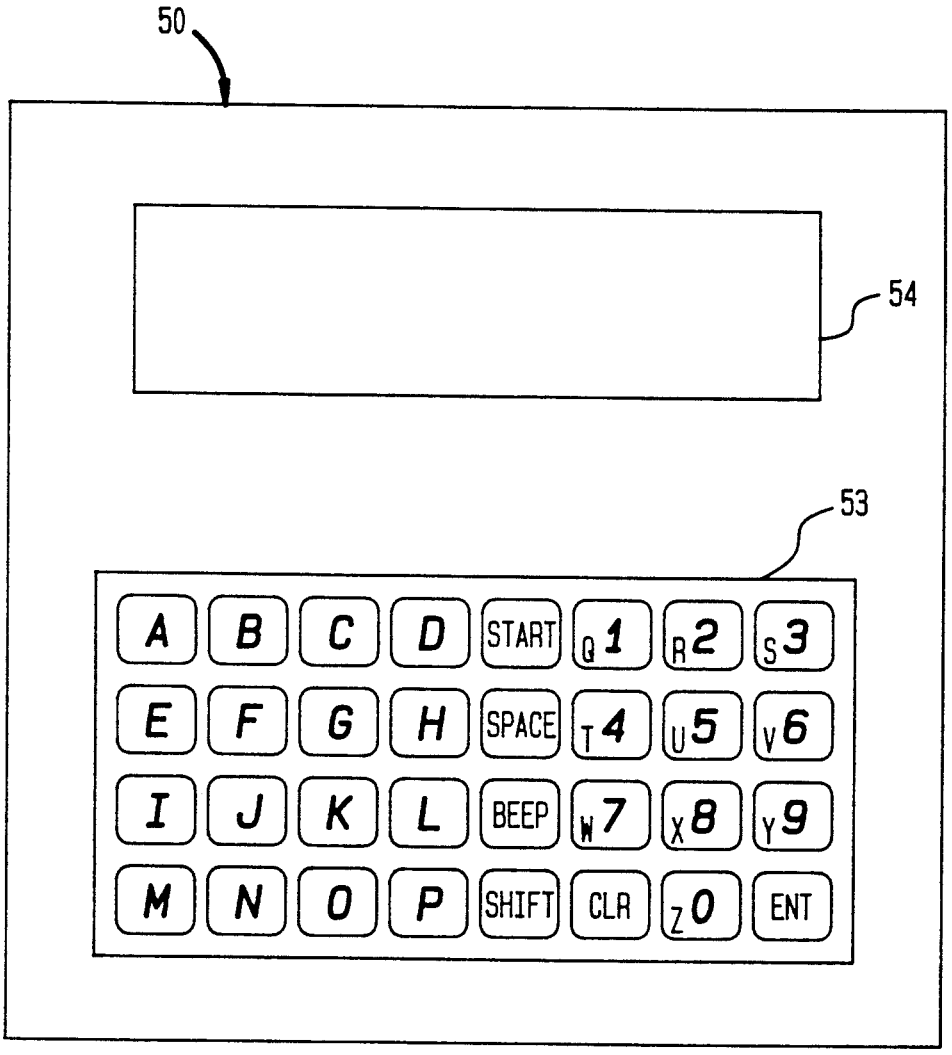
FIG. 4 is a top view of a useful control panel.

There is a control panel 50 such as shown in FIG. 4, which is located to be within view and reach of the operator. Preferably the control panel 50 is connected to frame 12 by extension 52. The control panel 50 can contain a data input means such as a keyboard 53 and display 54.

Preferred keyboard 53 is made by the Eastprint Corporation and the keys are arranged in a 4×8 matrix. The first 16 letters of the alphabet are in the first 4×4 grid. The numbers, plus a clear and enter key, are in the right hand 3×4 grid. Control keys start, space, beep and shift are located in the fifth column. This particular keyboard has a 13 pin connector which can fit directly into the circuit board on which the computer is located.

The preferred display 54 is a liquid crystal display, with the most preferred display being a 64×256 dot matrix liquid crystal LM213XB made by Hitachi Corporation. This display has a 17 pin connector which plugs directly into the computer board below it.

Figure 2:
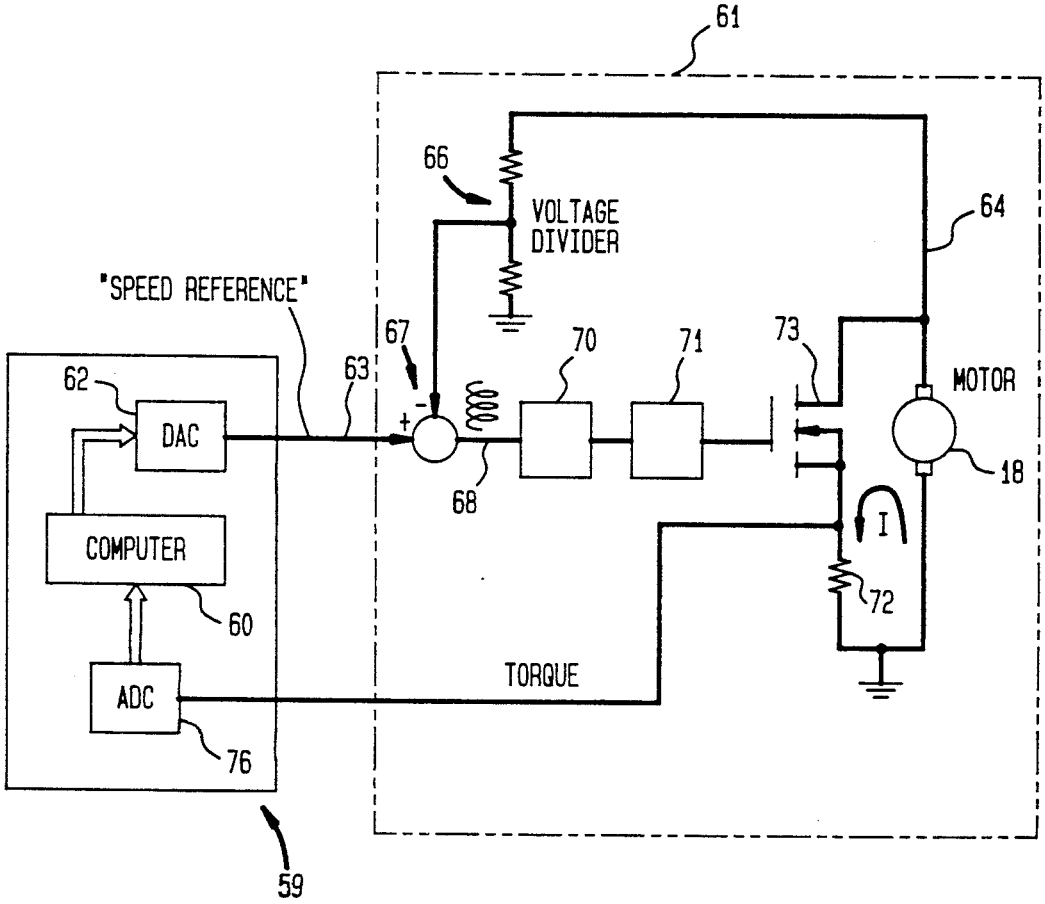
FIG. 2 is a circuit block diagram of a preferred circuit to control operation of the apparatus of the present invention.

Extension 52 is preferably hollow and acts as a conduit for electrical wires from the subassembly 19 to panel 50. Panel 50 is also a convenient place to house the computer and control circuit which are schematically shown in FIG. 2. Additionally, printed circuit board 10 contains some of the control electronics. Handle means such as handle bars 55 can be connected to extension 52.

There is a means to measure the input torque at the pedals. The motor current is adjusted by the speed servo which can be located on circuit board 10, to maintain a substantially constant pedal speed equal to the commanded "speed reference". This means that the motor supplied load torque ($T_m$) is controlled to balance the pedal input torque. This is true because a constant velocity implies a net torque difference ($T_p - T_m$) of zero. A current sense resistor 72 is used to measure motor current. This is possible because the same current which flows through the motor also flows through the sense resistor 72. By measuring the voltage across the sense resistor 72, the current is determined. A useful current sense resistor has a resistance of about 0.1 to 0.8 ohms with a resistance between 0.2 to 0.5 ohms preferred. The motor torque is directly proportional to the motor current.

The actual torque at the motor is continually affected by the pedaling input torque, and is a representation of the pedaling torque and is input into the computer. The computer continuously compares the pedaling input torque to the selected load torque setting. The computer continually uses the difference to update the "speed reference" command signal based on the integral of (pedal input torque minus load torque setting divided by a software selected inertia). If the software selected flywheel is a large number, this is equivalent to a large flywheel. If it is a small number, this is equivalent to a small flywheel. In practice, a very large assumed inertia does not create the smoothest ride.

A suitable means measures the back EMF voltage 64 of the motor. This is related to the actual pedaling speed. There is a means to compare and signal the difference of the back EMF signal and the commanded "speed reference" as defined above. The difference between the motor Back EMF voltage and the commanded speed can be received by amplifier means. The amplified signal is communicated to a device which controls the actual motor torque. As a result, pedal speed is smoothly controlled and updated as a function of the applied pedaling torque and the load torque setting.

A preferred circuit for a control means is speed reference command generator 59, as illustrated in FIG. 2. An 8 bit computer 60 such as an Intel 80C31 provides the "speed reference" command via its 8 bit data bus to a digital to analog converter (DAC) 62. The largest possible output from DAC 62 is 5 volts and represents a speed command value equivalent to a pedal speed of about 140 RPM.

The speed of the motor which is a representation of the pedaling speed is measured by taking the back EMF voltage of the motor via line 64 and dividing it down with voltage divider 66. The purpose of the divider 66 is to scale the pedaling speed voltage before it is compared at summing junction 67 against the "speed reference" command from the speed reference command generator 59. The divider 66 reduces the motor generated voltage so that at the highest pedaling speed, the output voltage is less than 5 volts. In essence, the pedaling speed signal as measured by the back EMF 64 is adjusted to be within the signal range from the DAC 62. If there is a difference, an error signal is generated. This error signal is sent via line 68 and amplified by amplifier 70. The amplifier 70 can be any suitable amplifier with an LM324 preferred. The amplified signal is filtered by a resistor and capacitor network 71 before being applied to a Field Effect Transistor (FET) 73. The FET 73, preferably an IRF140, produces a current in the motor proportional to the applied voltage from the filter. The FET 73 acts as a variable resistor to control the motor current. The FET 73 is preferably used in combination with a heat sink 74 which is capable of dissipating at least 50 and more preferably at least 100 watts.

The motor current produces a proportional load torque which regulates the speed according to the "speed reference" command. The speed command is continuously updated based on the difference between the pedaling input torque and the load torque setting and the selected inertia. The instantaneous current (or motor torque) is sensed by current sense resistor 72 and signaled to the computer 60 in the speed reference command generator 59 via an 8 bit analog to digital converter (ADC) 76.

Figure 5:
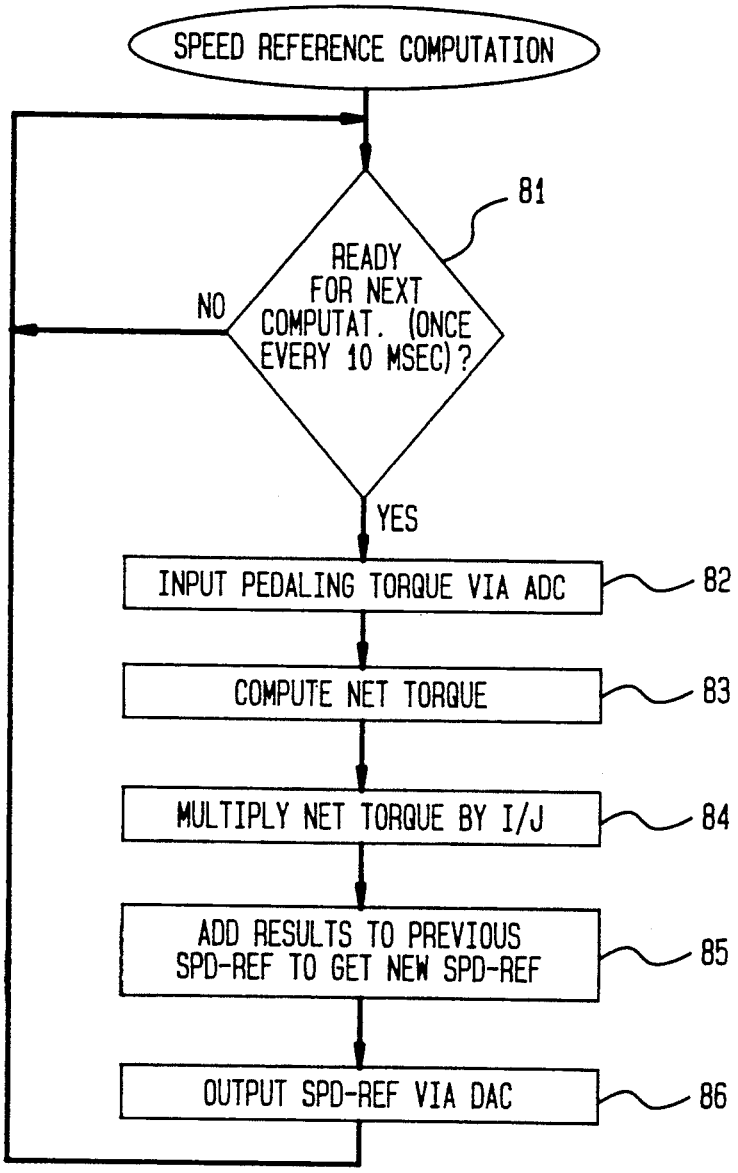
FIG. 5 illustrates a software flow diagram for a speed reference computation.

The motor current can be sampled at any desired rate; but the sampling rate must be sufficient to provide the actual pedaling torque corresponding to the sinusoidal pedaling curve as shown in FIG. 3. FIG. 5 illustrates a software flow diagram for the speed reference computation. At a uniform sampling rate of about 10 milliseconds as shown by box 81, the motor current is read into the computer 60 (FIG. 2) and is calibrated in box 82 to represent the instantaneous pedaling input torque. Based on a manual or automatic load torque setting, the computer has a preset load torque value. At each sampling period, the computer at box 83 calculates the difference between the load torque setting and the pedal torque applied to the pedals. At box 84 the difference is divided by the selected inertia value in the computer and at box 85, added to the previous "speed reference" command to obtain the new "speed reference" command. As shown in box 86, the new "speed reference" command is outputted from the computer 60 to the DAC 62.

The selected value of the inertia is experimentally determined for the smoothest ride. If the selected inertia is large, over one cycle of pedaling, the "speed reference" and thus the pedaling speed changes only by a small amount in an analogous manner to a large physical flywheel. This is true even though the torque applied to the pedals changes by a large amount as shown in FIG. 3. The torque difference is divided by the selected inertia and the results are added or subtracted from the "speed reference" command every sampling period. The actual pedaling speed will follow the speed reference command because of the speed servo.

In summary, the present invention provides an electronic flywheel which acts to simulate the action of a large physical flywheel. It accomplishes this by regulating the pedaling speed by adjusting the motor load torque. As the pedaling torque varies, the speed can gradually change. By regulating the pedal speed at an average motor torque equal to the load torque setting, a mechanical flywheel is simulated.

COMPUTER PROGRAM FOR AN ELECTRONIC FLYWHEEL

The electronic flywheel is comprised of both hardware and software. The speed servo 61 is performed in hardware and the "speed reference" command 63 used by the speed servo 61 is generated by the software as described in FIG. 5. This division of work allows each to perform the function it can do best.

The updating of the "speed reference" is preferably performed at a sampling rate of 100 times per second (or every 10 milliseconds). This number is based on the time for a pedal revolution. At a speed of 120 RPM, the time for a complete pedal revolution is 500 milliseconds. Because the applied pedaling torque has a peak and valley for each foot during a pedal revolution, the period for the sinusoidal torque waveform produced is 250 milliseconds. At a sampling rate of 10 milliseconds, a sufficient number of samples is taken to represent the sampled waveform. The hardware circuitry required to perform the speed servo is minimal and the continuous rather than sampled operation is preferred.

The computer program sequentially performs the individual program modules which make up the program. After the modules are completed, the program remains in an idle state waiting for a timer interrupt to occur. When the interrupt occurs, the sequence is repeated. This interrupt occurs periodically at a 10 millisecond rate and is the program driver; therefore, all routines must be completed in less than 10 milliseconds. One of the program modules is responsible for updating and displaying time during an exercise session. This is accomplished by updating the seconds after 100 passes through the timer routine. The sampling rate for the software flywheel is also based on the 10 millisecond timer interrupt.

The heart of the electronic flywheel is the generation of the "speed reference" command signal. As this value changes, the pedaling speed changes because the speed servo 61 forces them to be equal. Over a single revolution of the pedals, the "speed reference" and therefore the pedaling speed will change by a small amount. The rate of change of the "speed reference" depends on the selected inertia value. This value can be modified by keyboard entry.

It is possible to choose an inertia value which would be equivalent to an enormously large flywheel. If this were done, it would be difficult to increase the pedal speed because the computed "speed reference" would change very slowly. This would be true even if the applied pedaling torque is much greater than the torque setting. It is for this reason that the selected value is experimentally determined by the smoothest pedaling operation. The update of the "speed reference" command and therefore the pedaling speed is based on the same equation (as recited above) which determines speed for a conventional flywheel. To implement the equation in software, the integral of the net torque is approximated by a summation. The division by the inertia is equivalent to a multiplication by the reciprocal as shown by box 84 of FIG. 5. To increase the selected inertia, multiply by a smaller number. This reduces the rate that the "speed reference" command can change. At the sampling rate, the net torque is multiplied by the reciprocal of the selected inertia and the results are added or subtracted from the "speed reference" command.

To obtain the pedaling torque, an ADC 76 reads the voltage across a sense resistor 72 in series with the motor. This voltage represents the motor current and therefore the actual motor torque; but because the speed over a pedal revolution is almost constant, the motor torque must equal the pedaling torque. A software subroutine in computer 60 communicates with the ADC 76 and this enables the computer to obtain the pedaling torque. Because the computer has the load torque setting and selected inertia stored in memory, it can update the "speed reference" command. The present load torque setting is constantly displayed.

The computer outputs the "speed reference" command to a digital to analog converter (DAC) 62. The largest possible analog voltage out of the DAC 62 is 5 volts. The speed servo compares, at junction 67, this voltage to the motor voltage which represents the pedaling speed. Before the comparison is made, the motor voltage is scaled (i.e., system calibration) down such that at the highest speed the voltage is less than 5 volts. The voltage produced across the motor terminals is directly proportional to the motor Back EMF constant and the pedaling speed. The speed servo 61 amplifies the difference (or error signal) between the "speed reference" command and the scaled motor voltage. The amplified signal is then used to control the motor torque. This process forces the pedaling speed to produce a voltage which matches the "speed reference" voltage. Thus, the "speed reference" is a representation of the pedaling speed.

To convert the "speed reference" value to a pedaling speed in RPM, the program multiplies it by a calibration constant stored in memory. The results are then displayed. To calibrate the displayed speed, the person pedaling counts the number of revolutions in one minute (while pedaling at a constant speed as noted by the display). If the count does not agree with the displayed value, a keyboard entry updates the calibration constant. This value is permanently stored in computer 60 memory until updated at a future date. The keyboard can be used to input variables including selected inertia, and load torque settings at any time.

The use of computer 60 in combination with the preferred panel 50 having display 54 in combination with preferred keyboard 53, enables this apparatus to have many types of control flexibility and measurements, as well as numeric and graphic interaction. A useful and preferred keyboard contains means to input the whole alphabet and numeric digits 1 through 9, plus 0. The system can have a means to have audio communication with the operator, whether it be by simulated voice, or sound. Additionally, the liquid crystal display 54 can be used to graphically represent the system performance with time. Analogous representations of speed and torque can be calibrated to the actual pedaling speed and torque. In this way, simulated tours over hills can be made. There can be a means electronically connected between computer 60 and the operator to monitor operator heartbeat. The operator heartbeat can continuously be measured and displayed on display 54. The operator can program the computer based on the operator's physical heartbeat.

The computer can have a memory storage which is coded to a particular operator to measure parameters, such as the length of time and dates the apparatus is used, as well as graphing performance along different exercise routines. As can be appreciated, depending on operator input, the possibilities of varying the use of the load torques with time or preset trips is endless.

While exemplary embodiments of the invention have been described, the true scope of the invention is to be determined from the following claims.

What is claimed is:

1. A stationary exercise bicycle comprising:

a frame;

a seat and a pair of pedal-operated crank arms connected to said frame to enable a user to provide an input pedal torque at an input pedal speed; and an electronic flywheel connected to said frame which performs equivalently to a large conventional flywheel, wherein said electronic flywheel comprises:

data input means to enable said user to input preset load torque;

speed reference command generator means to provide a time varying speed reference command signal as a function of difference between said input pedal torque and said preset load torque, wherein said speed reference command generator means comprising computer means for computing said time varying speed reference command signal according to the following equation:

$$S=\int(T_p-T_1)/J$$

where:

S is defined as said time varying speed reference command signal;

$T_p$ is defined as said input pedal torque;

$T_1$ is defined as said preset load torque; and

J is defined as a selected valued which corresponds to inertia; and speed servo control means for controlling said input pedal speed to equal said time varying speed reference command signal, the speed servo control means comprising a load torque means.

2. A stationary exercise bicycle comprising:

a frame;

an adjustable seat located on said frame to enable a user to sit on said adjustable seat;

power transmission means and a pair of pedal-operated crank arms connected to said frame to enable said user to provide an input pedal torque at an input pedal speed to drive a common input shaft of said power transmission means;

torque measuring means to measure said input pedal torque;

data input means to enable said user to input preset load torque;

speed reference command generator means connected to said frame to provide a time varying speed reference command signal as a function of difference between said input pedal torque and said preset load torque; and speed servo control means connected to said frame for controlling said input pedal speed to equal said time varying speed reference command signal, the speed servo control means comprising a load torque means, speed detecting means to measure said input pedal speed, a summing amplifier to receive and compare summing difference between said input pedal speed and said time varying speed reference command signal, an amplifier to amplify said summing difference and to provide an amplified difference, filter means to filter said amplified difference and to provide a filtered amplified difference, and a power transistor connected across armature of said load torque means and controlled by said filtered amplified difference to provide a variable resistance across said armature to control current flowing through said load torque means and to force said input pedal speed to equal said time varying speed reference command signal.

3. The stationary exercise bicycle in accordance with claim 2 wherein said load torque means can generate an average load torque which is substantially equal to the preset load torque.

4. The stationary exercise bicycle in accordance with claim 3 wherein said data input means comprises a control panel having a display and keyboard means to display said preset load torque and said input pedal speed.

5. The stationary exercise bicycle in accordance with claim 3 wherein said preset load torque comprises a varying series of simulated tours over hills.

6. The stationary exercise bicycle in accordance with claim 2 wherein said load torque means comprises:

a DC permanent magnet motor having a rotation shaft coupled to said pair of pedal-operated crank arms through said power transmission means.

7. The stationary exercise bicycle in accordance with claim 6 wherein said DC motor is driven by said input pedal torque and operates as a generator to provide load torque according to magnitude of said current flowing through said DC motor.

8. The stationary exercise bicycle in accordance with claim 7 wherein said torque measuring means to measure said input pedal torque comprises:

a current series resistor in series with said DC motor and said power transistor wherein said current flowing through said DC motor flows through said current sense resistor which produces a voltage proportional to said current flowing through said DC motor.

9. A stationary exercise bicycle in accordance with claim 8 wherein said speed reference command generator means comprises:

an analog to digital converter for receiving said voltage proportional to said current flowing through said DC motor and for providing a digitized signal;

computer means for receiving said digitized signal and said preset load torque profile, and for updating said time varying speed reference command signal; and a digital to analog converter for receiving said time varying speed reference command signal from said computer means, for converting said time varying speed reference command signal to analog time varying speed reference command signal and for providing said analog time varying speed reference command signal to said speed servo control means.

10. The stationary exercise bicycle in accordance with claim 7 wherein said speed detecting means comprises a voltage divider connected across back EMF voltage of said DC motor.

11. The stationary exercise bicycle in accordance with claim 7 wherein said speed detecting means comprises tachometer generator means.

12. The stationary exercise bicycle in accordance with claim 7 wherein said speed reference command generator means comprises:

an analog to digital converter to receive a signal proportional to said current flowing through said DC motor which represents said input pedal torque and to provide a digitized output;

computer means to receive said digitized output, to update said time varying speed reference command signal at a periodic rate by adding an amount proportional to said difference between said digitized output and said preset load torque profiles; and a digital to analog converter to communicate said updated time varying speed reference command signal to said speed servo control means.

13. The stationary exercise bicycle in accordance with claim 12 wherein said computer means updates said time varying speed reference command signal according to the following equation:

$$S=\int(T_p-T_1)/J$$

where:

S is defined as said time varying speed reference command signal;

$T_p$ is defined as said input pedal torque;

$T_1$ is defined as said preset load torque; and

J is defined as a selected value which corresponds to inertia.

14. The stationary exercise bicycle in accordance with claim 6 wherein said power transmission means comprises:

a gear box comprising a low speed gear box shaft and a high speed gear box shaft, said pair of pedal-operated crank arms being connected to said low speed gear box shaft and said high speed gear box shaft being coupled to said DC motor; and a flexible coupling between said DC motor and said high speed gear box shaft.

15. The stationary exercise bicycle in accordance with claim 14 wherein said power transmission means further comprises:

a small flywheel on said high speed gear box shaft.

16. A stationary exercising apparatus comprising:

a stationary bicycle comprising a seat connecting to a frame, and a gearbox, wherein said gearbox is connected to pedals for producing an input torque by a user at an input pedal speed; and an electronic flywheel which performs equivalently to a large conventional flywheel, wherein said electronic flywheel comprises:

data input means to enable said user to input preset load torque;

speed reference command generator means connected to said frame to provide a time varying speed reference command signal as a function of difference between said input torque and said preset load torque, wherein said speed reference command generator means comprising computer means for computing said time varying speed reference command signal according to the following equation:

$$S=\int(T_p-T_1)/J$$

where:

S is defined as said time varying speed reference command signal;

$T_p$ is defined as said input pedal torque;

$T_1$ is defined as said preset load torque; and

J is defined as a selected valued which corresponds to inertia; and speed servo control means connected to said frame for monitoring said input pedal speed, for receiving said time varying speed reference command signal from said speed reference command generator means and for equating said input pedal speed with said time varying speed reference command signal, the speed servo control means comprising a load torque means, speed detecting means to measure said input pedal speed, a summing amplifier to receive and compare a summing difference between said input pedal speed and said time varying speed reference command signal, an amplifier to amplify said summing difference and to provide an amplified difference, filter means to filter said amplified difference and to provide a filtered amplified difference, and a power transistor connected across armature of said load torque means and controlled by said filtered amplified difference to provide a variable resistance across said armature to control current flowing through said load torque means and to force said input pedal speed to equal said time varying speed reference command signal.

17. The stationary exercising apparatus in accordance with claim 16 wherein the load torque means comprises:

a permanent magnet DC motor mounted on said frame and connected to said gearbox.

18. The stationary exercising apparatus in accordance with claim 17 wherein said speed reference command generator means comprises:

an analog to digital converter for receiving voltage proportional to current flowing through said DC motor and for providing a digitized signal;

computer means for receiving said digitized signal, and for updating said time varying speed reference command signal; and a digital to analog converter for receiving said updated time varying speed reference command signal from said computer means, for converting said updated time varying speed reference command signal to analog and for providing said analog time varying speed reference command signal time varying speed reference command signal to said speed servo control means.

* * * * *